US008991597B2

(12) United States Patent
Webb

(10) Patent No.: US 8,991,597 B2
(45) Date of Patent: Mar. 31, 2015

(54) GARMENT BAG

(75) Inventor: Richard Sebastian Hawksley Webb, Esher (GB)

(73) Assignee: Shirtroll Limited, London (GB)

( * ) Notice: Subject to any disclaimer, the term of this patent is extended or adjusted under 35 U.S.C. 154(b) by 1465 days.

(21) Appl. No.: 12/096,546

(22) PCT Filed: Dec. 6, 2006

(86) PCT No.: PCT/SG2006/000380
§ 371 (c)(1),
(2), (4) Date: Jun. 6, 2008

(87) PCT Pub. No.: WO2007/067152
PCT Pub. Date: Jun. 14, 2007

(65) Prior Publication Data

US 2008/0289979 A1 Nov. 27, 2008

(30) Foreign Application Priority Data

Dec. 8, 2005 (GB) ..... 0525013.9

(51) Int. Cl.
*B65D 85/18* (2006.01)
*A45C 3/00* (2006.01)

(52) U.S. Cl.
CPC ..... *A45C 3/004* (2013.01); *B65D 85/182* (2013.01); *Y10S 190/901* (2013.01)
USPC ..... 206/294; 206/278; 206/279; 206/284; 206/287.1; 206/289; 291/292; 291/293; 291/297; 291/298; 190/113; 190/107; 190/100; 190/102; 190/901

(58) Field of Classification Search
USPC ..... 206/278, 279, 284, 287, 287.1, 289, 206/291, 292, 293, 297, 298; 190/113, 107, 190/100, 102, 901
See application file for complete search history.

(56) References Cited

U.S. PATENT DOCUMENTS 1,641,747 A * 9/1927 Doud ..... 206/287
1,975,294 A 10/1934 Sand et al.
(Continued)

FOREIGN PATENT DOCUMENTS

CN 1042123 A 5/1990
CN 2297946 Y 11/1998
(Continued)

OTHER PUBLICATIONS

Sky Roll Roll-Up Garment Bag. Downloaded Oct. 12, 2008 at http://images.google.com/imgre?imgurl=http://ecx.images-amazon.com/i . . . http://www.fabsugar.com/410452/print.

*Primary Examiner* — Fenn Mathew
*Assistant Examiner* — Cynthia Collado
(74) *Attorney, Agent, or Firm* — Dickstein Shapiro LLP

(57) ABSTRACT

A garment bag for a collared shirt, the bag comprising a receptacle (52) arranged to receive a first portion of a shirt including the collar (26) and cover (40) arranged to receive the remainder of the said shirt and be rolled up around the receptacle, the receptacle being of greater rigidity than the cover. A method of folding a shirt having a back portion, two front portions, two sleeves and a collar is also disclosed, the method comprising the steps of folding the shirt centrally of the back and between the back and both front portions so that the back lies folded between the front portions, positioning one sleeve along each front portion, protecting the collar and rolling the remainder of the shirt around the protected collar. Preferably the shirt folding method and garment bag are used together.

18 Claims, 14 Drawing Sheets

(56) References Cited

U.S. PATENT DOCUMENTS

| | | | | | |
|---|---|---|---|---|---|
| 1,988,530 | A | * | 1/1935 | Wheary | 206/289 |
| 2,370,492 | A | * | 2/1945 | Russell | 206/279 |
| 2,385,053 | A | * | 9/1945 | Bohn | 223/98 |
| 2,502,033 | A | * | 3/1950 | Bohn | 206/293 |
| 2,533,333 | A | * | 12/1950 | Kitson | 190/111 |
| 2,540,165 | A | * | 2/1951 | Fiel | 190/111 |
| 3,621,991 | A | | 11/1971 | Richter | |
| 3,831,740 | A | | 8/1974 | Pendergast et al. | |
| 3,944,032 | A | * | 3/1976 | Samhammer et al. | 206/292 |
| 3,945,415 | A | | 3/1976 | Febuary | |
| 4,529,086 | A | | 7/1985 | New | |
| 4,801,010 | A | | 1/1989 | Levitas | |
| 4,919,262 | A | * | 4/1990 | Kuroishi | 206/287.1 |
| D312,899 | S | * | 12/1990 | Faulkner | D32/8 |
| D336,988 | S | * | 7/1993 | Wehrley | D3/278 |
| 5,413,198 | A | | 5/1995 | Ferris | |
| D360,795 | S | * | 8/1995 | Saunders | D6/601 |
| 5,460,302 | A | | 10/1995 | Foraker | |
| 5,509,588 | A | * | 4/1996 | Kimball | 223/98 |
| 5,566,797 | A | | 10/1996 | Van Himbeeck | |
| 5,575,391 | A | * | 11/1996 | Gerch | 206/527 |
| 5,624,026 | A | | 4/1997 | Chernoff | |
| 5,887,711 | A | | 3/1999 | McAuliffe | |
| 6,012,573 | A | | 1/2000 | Kurimoto | |
| 6,237,761 | B1 | | 5/2001 | Godshaw et al. | |
| 6,237,762 | B1 | | 5/2001 | Faircloth | |
| 6,543,072 | B2 | * | 4/2003 | Hsu | 5/413 R |
| 6,634,044 | B1 | * | 10/2003 | Wright | 5/625 |
| 7,134,535 | B1 | * | 11/2006 | Horvat | 190/20 |
| 7,171,707 | B2 | * | 2/2007 | Landay | 5/413 R |
| D587,012 | S | | 2/2009 | Webb | |
| 2004/0016657 | A1 | | 1/2004 | Glaser et al. | |
| 2006/0086628 | A1 | | 4/2006 | Deutschendorf et al. | |
| 2007/0261975 | A1 | | 11/2007 | Rabinoff | |

FOREIGN PATENT DOCUMENTS

| | | |
|---|---|---|
| CN | 2394457 Y | 9/2000 |
| DE | 1 710 577 | 8/1971 |
| DE | 298 03 568 | 8/1998 |
| GB | 898062 | 6/1962 |
| JP | 7-156941 | 6/1995 |
| WO | WO 94/24899 | 11/1994 |

* cited by examiner

GARMENT BAG

FIELD AND BACKGROUND OF THE INVENTION

This invention relates to a garment bag suitable for receiving a collared shirt and to a method of folding a shirt.

Collared shirts, particularly for business wear, are prone to creasing particularly when packed for travelling or shipping. Conventionally, such shirts are folded in a particular way which allows for easy transportation and, in the case of merchandising, display. The conventional folding method requires the shirt to be buttoned, the arms to be placed flat along the back of the shirt, both sides folded in a certain amount towards the middle of the back of the shirt and the shirt then folded in half. Particularly for merchandising and professional laundry use, the shirt is supported in this folded form with paper or plastic supports for the back and under the collar to reduce creasing, with the shirt then finally being protected by an outer container which may be in the form of a paper or plastics bag for a laundry establishment or made from stiffer transparent plastics for merchandising use.

It is a disadvantage of this folding method that the shirt is required to be folded on front and back on both sides and half way up the front of the shirt which leads to noticeable creases. Furthermore, the supports used in packaging the shirt are not generally reusable and also make the final packaged shirt quite bulky.

A packaging case for a folded shirt has been proposed in GB 2291797 which has been sold under the trademark "Stuffed Shirt" and provides support and protection for a shirt folded in a similar manner to that described above, but which can be reused. This proposal, however still has the disadvantage of requiring the shirt to be folded as described, leading to creases and the case needs to be robust and is thus bulky and expensive.

It is the object to the invention to provide a container and a folding method for a collared shirt which alleviates at least one of the disadvantages of the prior art and/or provides the general public with a useful choice.

SUMMARY OF THE INVENTION

In general terms, the invention provides a container for a shirt having a relatively rigid portion which receives a shirt collar and a relatively flexible portion for receiving the remainder of the shirt.

According to the invention in the first aspect, there is provided a garment bag for a collared shirt, the bag comprising a receptacle arranged to receive a first portion of the shirt including the collar and a cover arranged to receive the remainder of the shirt and be rolled up around the receptacle, the receptacle being of greater rigidity than the cover.

Preferably, the receptacle is in the form of a pocket and may have an arcuate surface against which the cover is arranged to be rolled.

The cover may have an opening to allow a said shirt to be received therein with the opening being preferably longitudinal and/or having means for closing the opening.

The receptacle is preferably crush-resistant.

The garment bag may further comprise fastening means connected to opposed faces of the cover and arranged to secure the cover in a rolled-up configuration and/or the receptacle and the cover may be of substantially the same width.

Preferably the receptacle acts as a former on which the cover is able to be rolled up.

The cover is preferably formed from sheet material with the receptacle being preferably formed from plastics material. The material(s) may also be water resistant.

The garment bag may also be formed from paper products.

The receptacle is connected to the cover and the receptacle may be releasably connected to the cover, with the receptacle preferably having an opening facing a corresponding opening of the cover. Alternatively, the receptacle may be separate from the cover.

The bag may be reusable or intended to be disposed of after a single use.

The invention extends to a garment bag of the first aspect of the invention and a shirt contained therein and to a shirt packaged for merchandising or after laundering in such a garment bag.

In an exemplary described embodiment not limiting on the scope of the present invention, the receptacle is formed as a crush-proof pocket to receive the collar, with the cover being in the form of an openable sack connected to the receptacle; the described garment bag is both simple and lightweight as well as providing a soft package to facilitate packing in small bags/cases.

According to the invention in the second aspect, there is provided a method of folding a shirt having a back portion, two front portions, two sleeves and a collar, comprising the steps of folding the shirt centrally of the back and between each front portion and the back, so that the back lies folded between the front portions, positioning one sleeve along each front portion, protecting the collar and rolling the remainder of the shirt around the protected collar.

Preferably the collar is raised and the shirt is folded adjacent the collar before the protecting step and the front portions and back are preferably folded concertina-fashion.

The collar is preferably protected by being placed in a receptacle and the remainder of the shirt may be received in a cover and the cover rolled up around the receptacle.

A shirt folded in this way has the advantage of requiring only a single visible fold on the body of the shirt (except the arms), centrally of the back of the shirt. The folds between the front and back are where seams joining the back to the front portions are usually provided and are hidden by the arms when the shirt is worn. A shirt folded in this way is thus less prone to visible creasing than the folding method of the prior art which has four longitudinal folds (two on the front, two on the back) and two transverse folds, on front and back, half way up the shirt.

Preferably, the folding method of the second aspect of the invention is used with the garment bag of the first aspect of the invention to provide a folded and rolled package.

BRIEF DESCRIPTION OF THE DRAWINGS

An embodiment of the invention will now be described by way of example with referenced to the accompanying drawings in which.

DETAILED DESCRIPTION OF THE PREFERRED EMBODIMENTS

Figure 1:
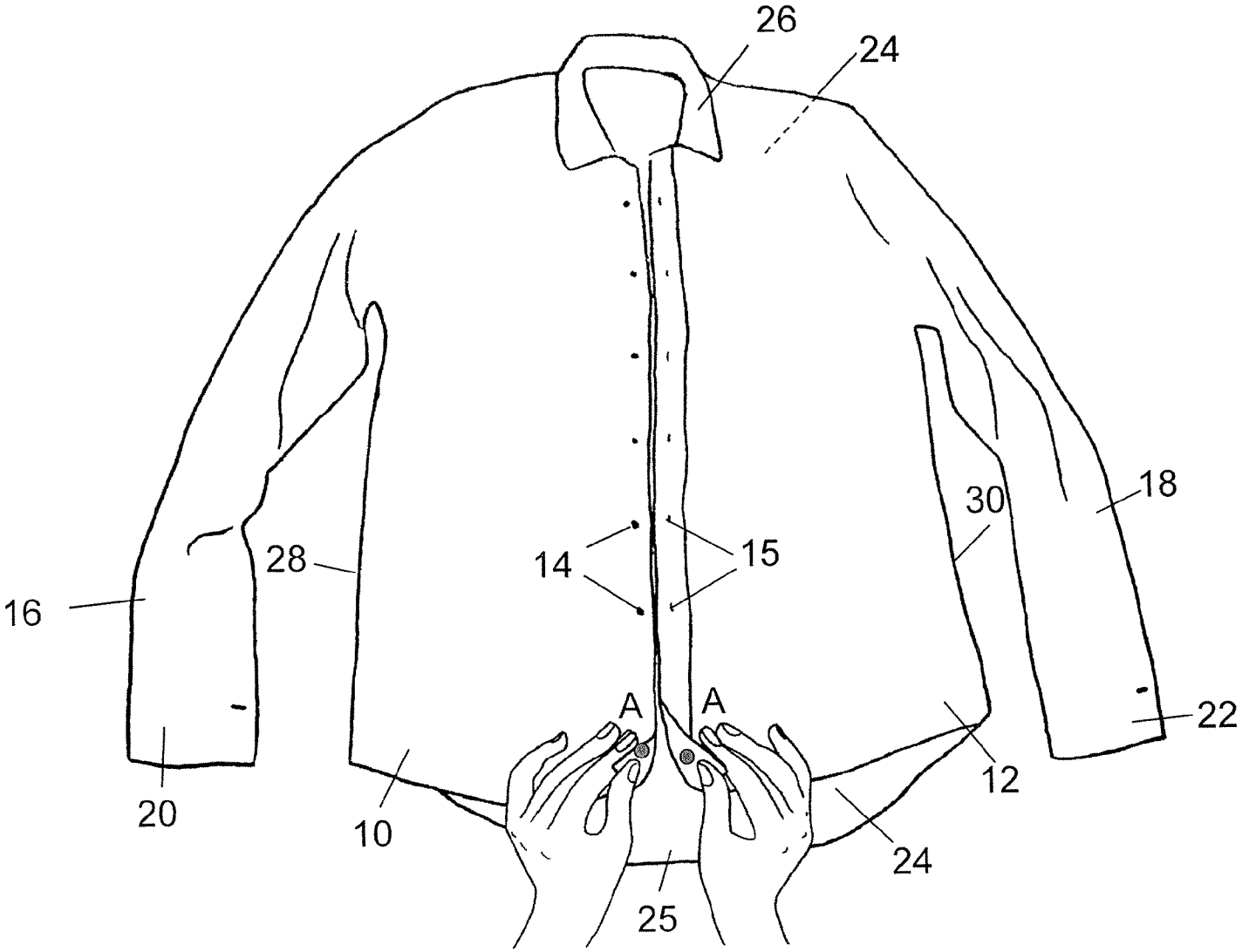
FIGS. 1 to 7 show various stages in folding a shirt for use with an embodiment of the first aspect of the invention.

With reference to FIGS. 1 to 7, a method of folding a collared shirt is shown. The shirt has two front portions 10, 12, buttons 14 and corresponding button holes 15, sleeves 16, 18, cuffs 20, 22, a back 24 having a shirt tail 25 and a collar 26. The back 24 is joined to each front portion 10, 12 at respective longitudinal seams 28, 30.

Figure 2:
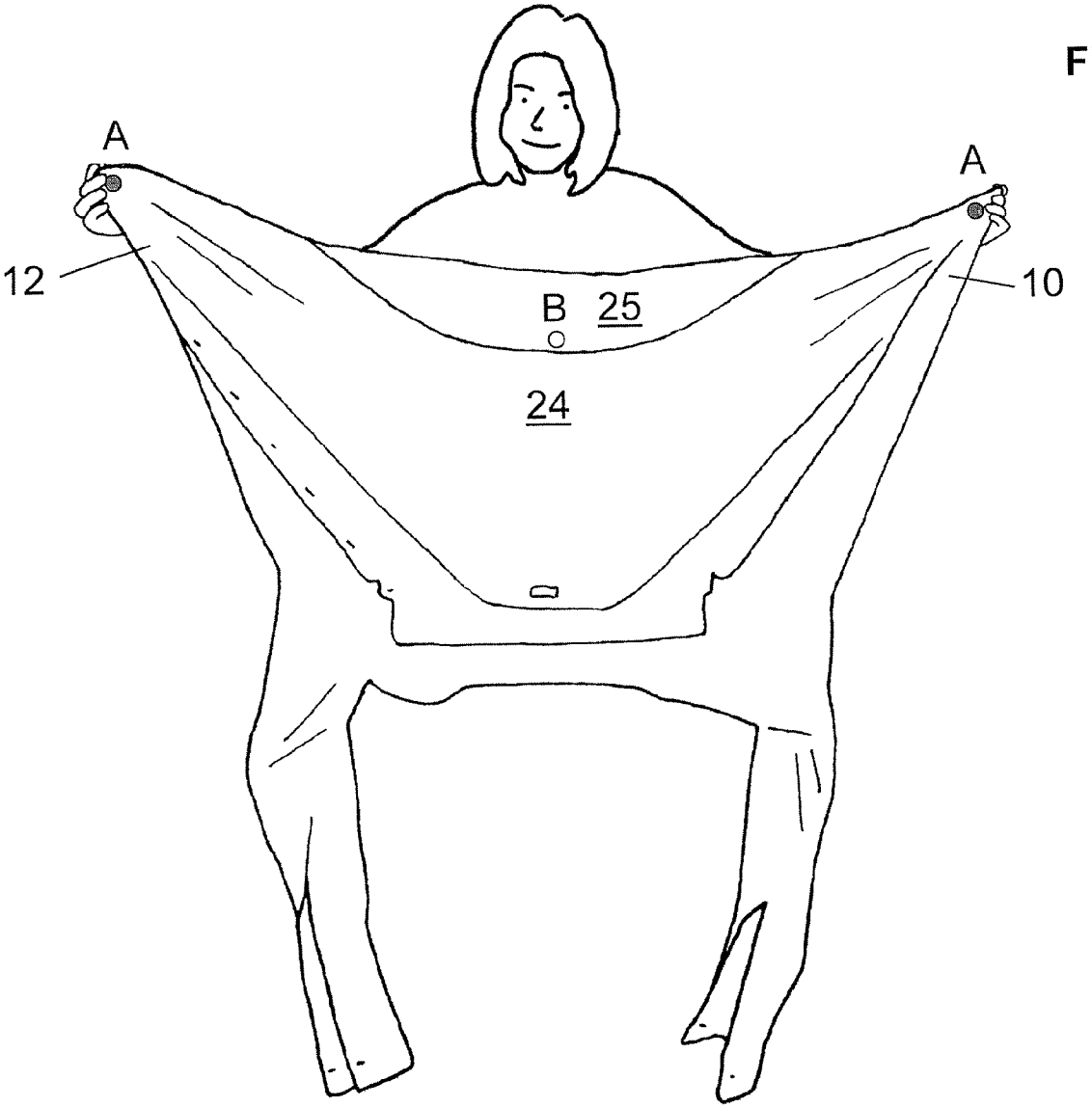
Figure 3:
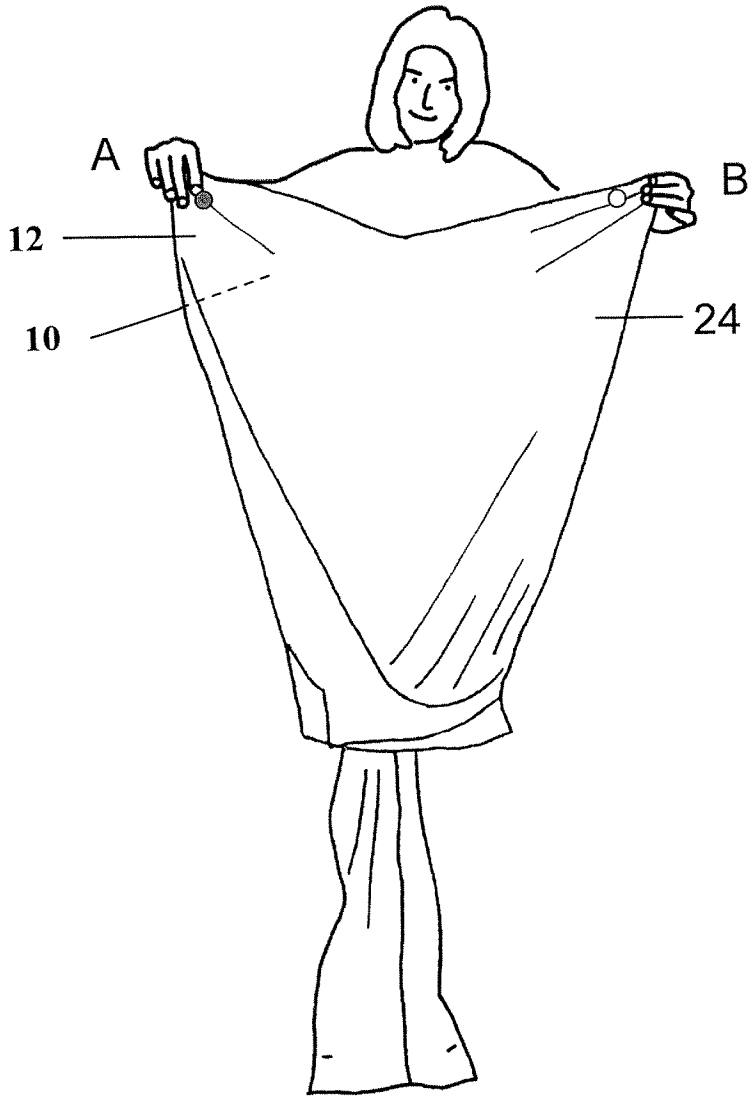

With reference to FIG. 1, the buttons 14 of the shirt are first undone and the cuffs 20, 22 (if the shirt has double cuffs) extended. The bottom corners of each front portion 10, 12 of the shirt, marked A in FIG. 1 are then grasped between index finger and thumb as shown and opened out so that the opening at the front of the shirt faces away from the person folding the shirt as shown in FIG. 2. Then the two corners A are brought together behind the shirt and held in one hand with the mid-point B of the shirt tail 25 being held in the other hand as shown in FIG. 3. Since the corners are brought behind the back, the body of the shirt is at this point inside-out.

Figure 4:
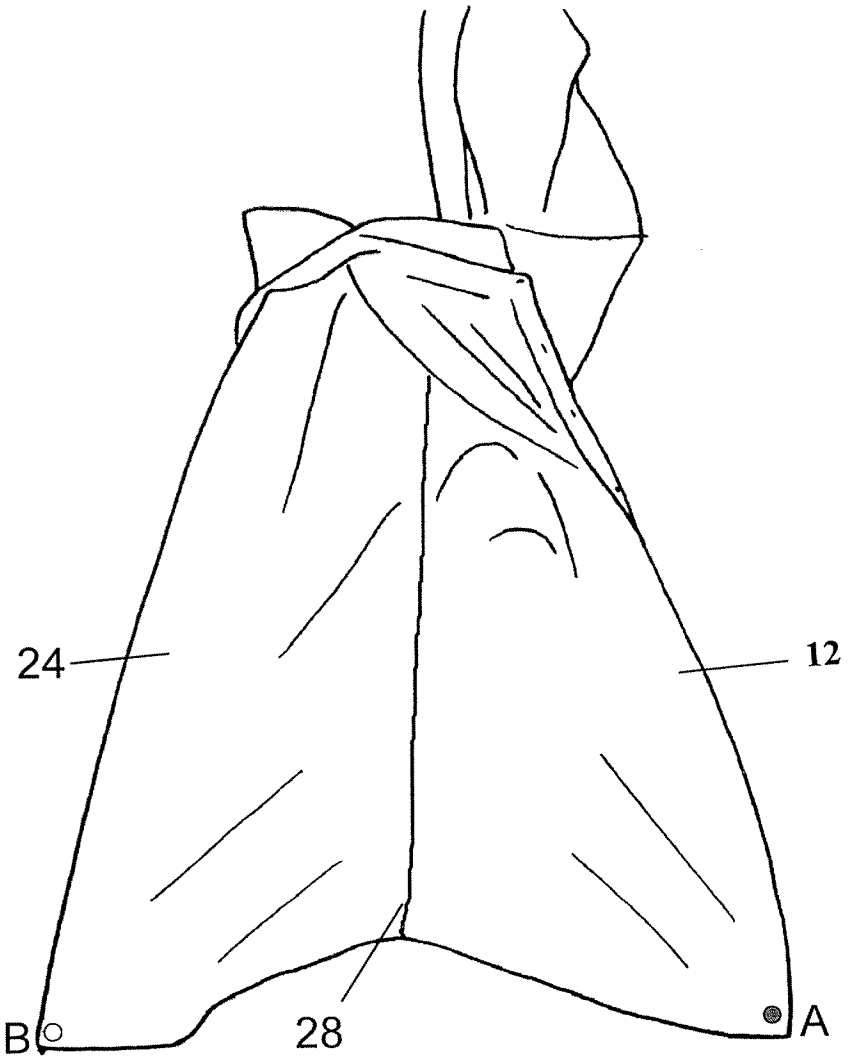
Figure 5:
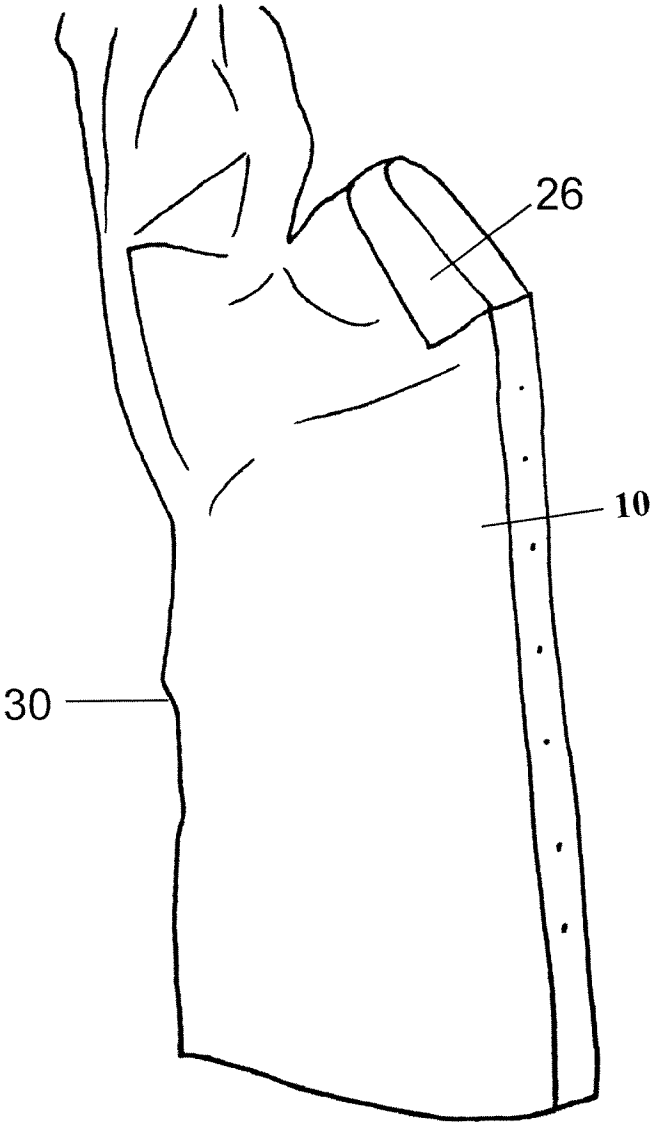

The shirt is then laid flat as shown in FIG. 4 and the upwardly facing corner A of side portion 12 is folded back on seam 28 to meet point B. The shirt is then turned over and the remaining corner A of side portion 10 is likewise folded back on seam 30 to meet point B as shown in FIG. 5, with the back 24 thus being folded between each side portion 10, 12 concertina fashion. At this point, the shirt should be inspected to ensure that all the layers 10, 24, 12 of the body of the shirt are smooth and wrinkle-free.

Figure 6:
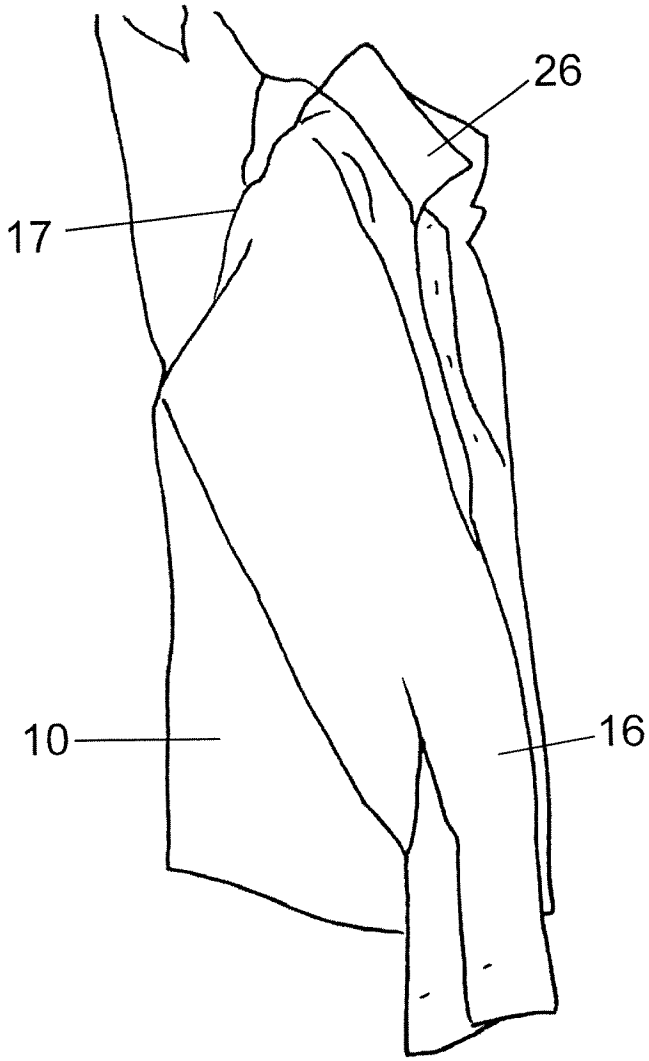

The collar 26 is then raised as shown in FIG. 6 and the sleeve 16 is positioned to lie alongside the front portion 10, ensuring that the end 17 of the sleeve 16, where this joins the front portion 10 and back 24, is not wrinkled.

Figure 7:
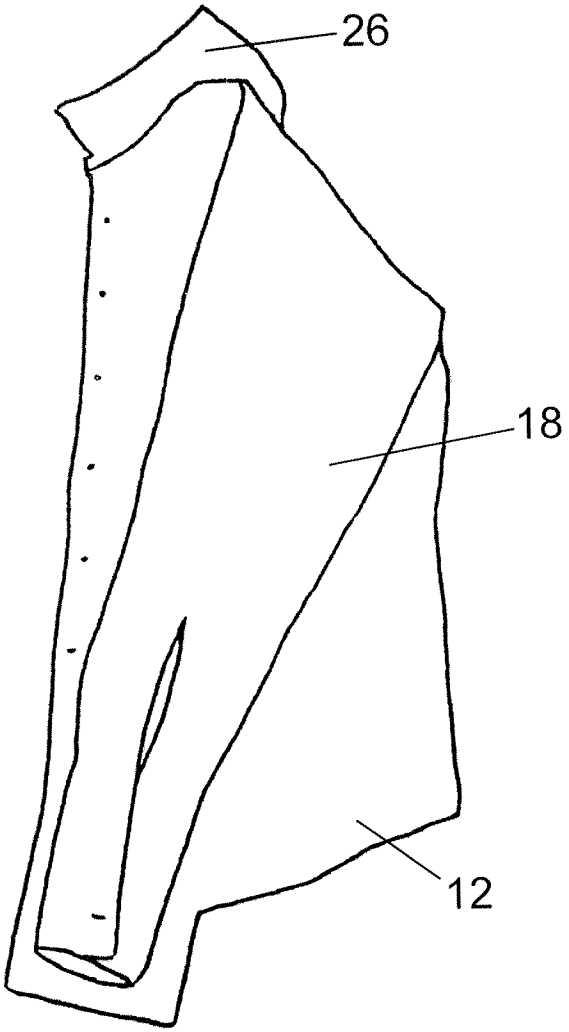
Figure 8:
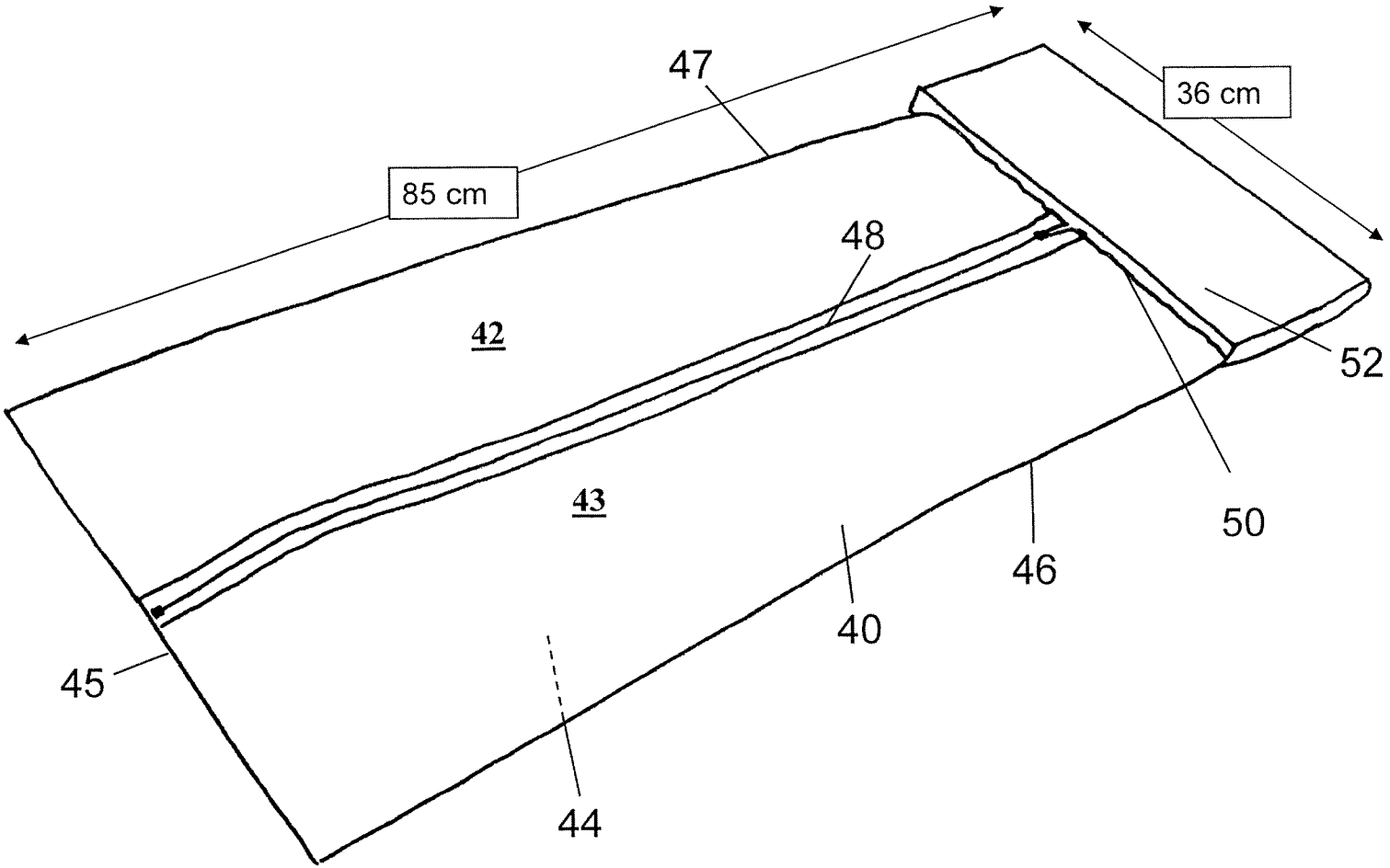
FIG. 8 is a three dimensional view of an embodiment of a garment bag according to a second aspect of the invention.

The shirt is then turned over and the process repeated for the sleeve 18, again ensuring that all layers are smooth and wrinkle-free as shown in FIG. 7.

A shirt folded in this form is then inserted into a garment bag which will now be described with reference to FIGS. 8 to 14.

The garment bag is of overall dimensions 85 cm×36 cm and has a cover 40 which provides a protective flexible sleeve to receive the body and arms of a shirt. The cover 40 is preferably formed from a lightweight water resistant sheet plastics material, for example nylon fabric or sheet polyethylene. The cover 40 has front 42, 43 and rear 44 portions which are sealed together at end 45 and along both longitudinal sides 46, 47. A longitudinal zip 48 is provided between the front portions 42, 43. The cover 40 has an open end 50 at which the rear portion 44 is connected to a receptacle 52 which provides a crush-proof pocket for a shirt collar and is shown in more detail in FIGS. 13 and 14. The receptacle 52 is of substantially the same width as the cover and has sides 54, 55, ends 56, 57 and an arcuate back 58. The front 60 of the receptacle 52 is open so that the receptacle forms a pocket of about 4 cm wide by 16 cm deep. The rear portion 44 of the cover 40 is connected to side 55 of the receptacle 52 by any suitable means, for example adhesive, rivets/connectors or plastics welding. The receptacle 52 is preferably formed by injection moulding from polyethylene having a side thickness of about 2 mm, so as to have structural integrity but yet be slightly pliable.

Figure 9:
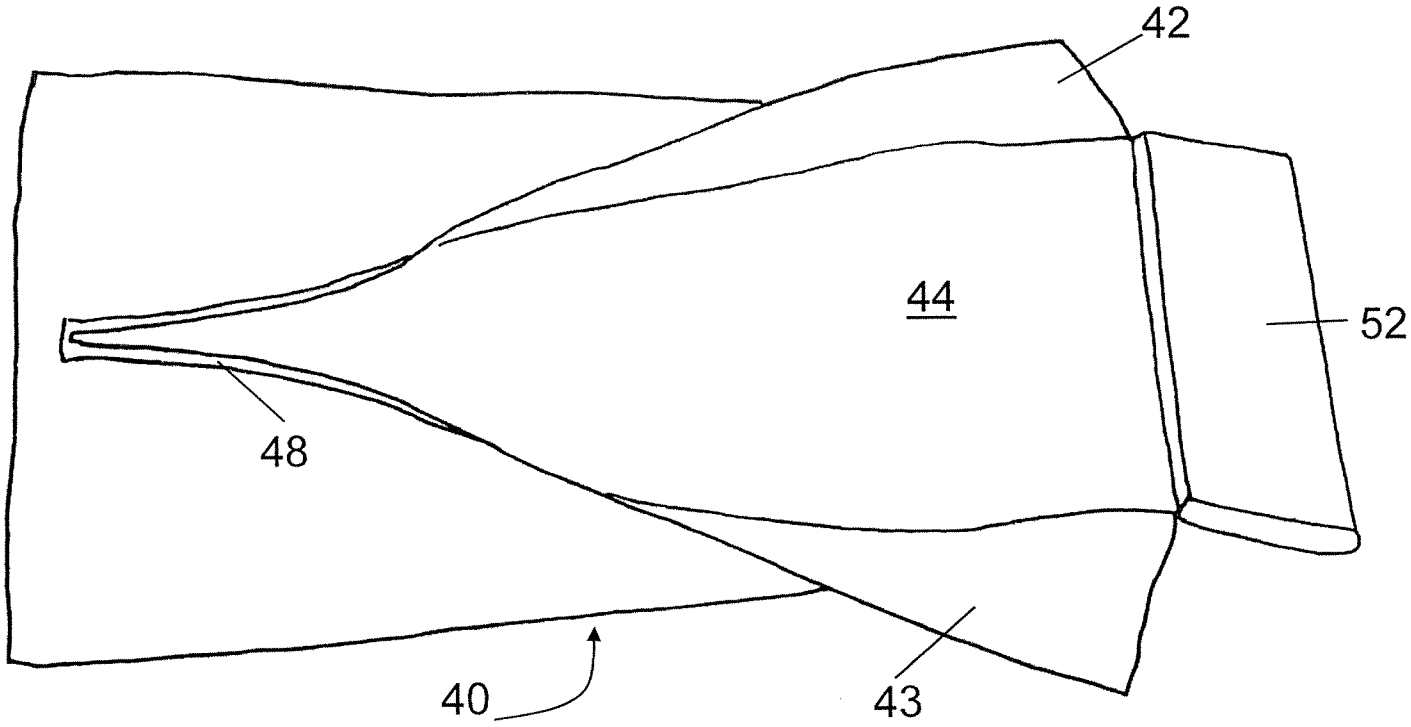
FIG. 9 is a view similar to FIG. 8 showing the garment bag in an open configuration.
Figure 10:
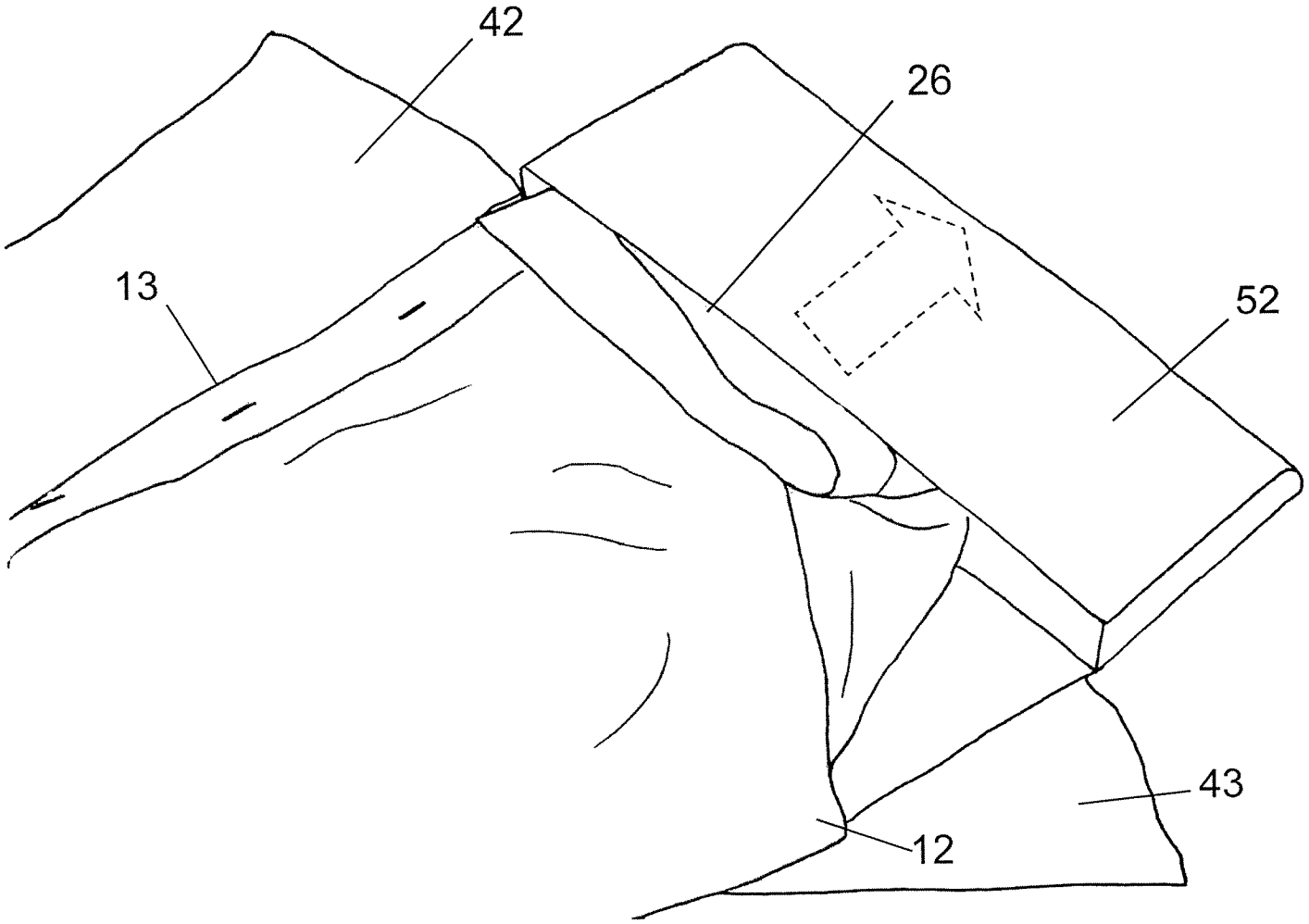
FIG. 10 is a view similar to FIG. 8 showing a shirt folded in accordance with the method described with reference to FIGS. 1 to 7 being inserted into the garment bag.
Figure 11:
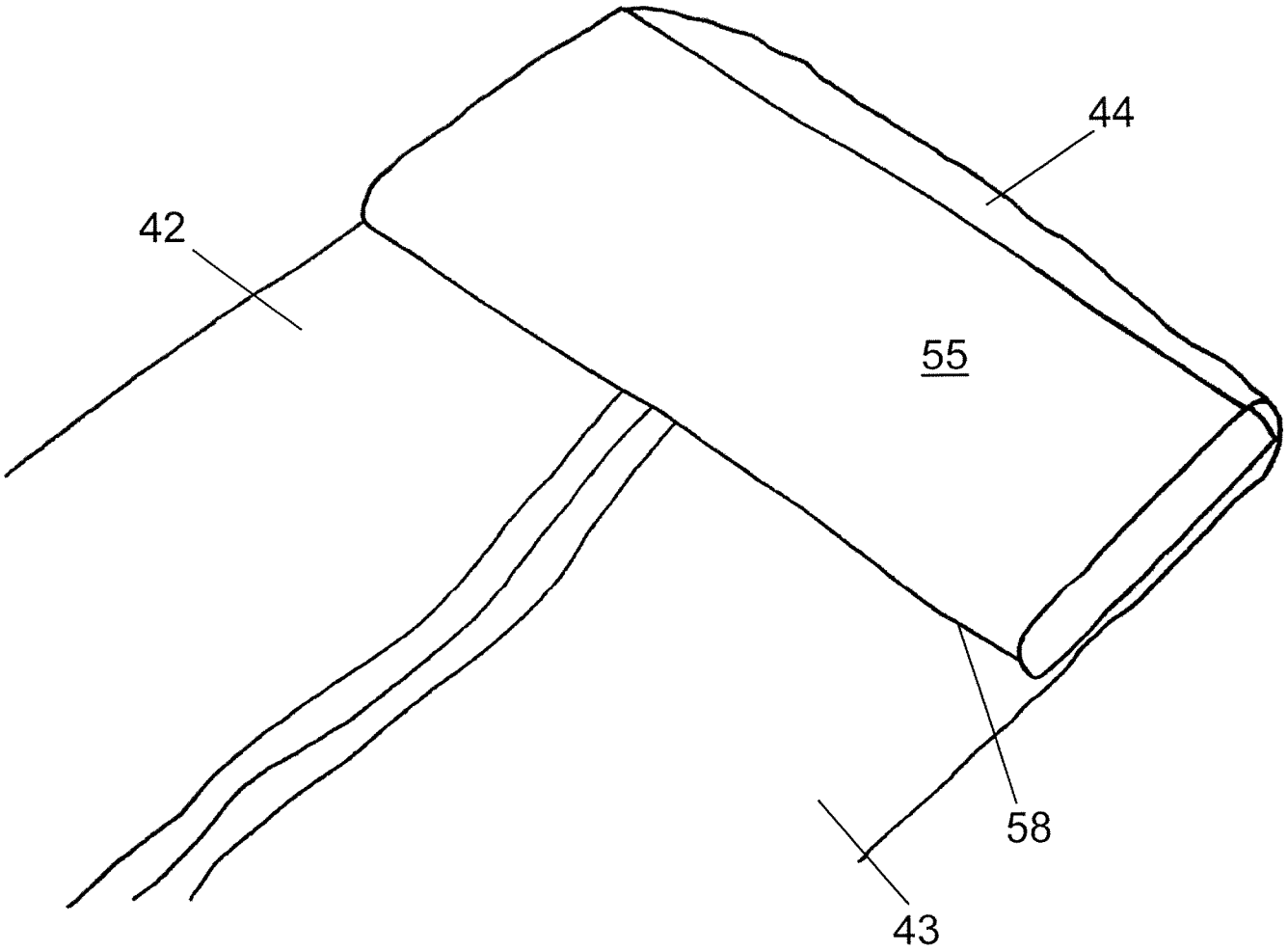
FIG. 11 shows the garment bag re-closed after receiving the shirt and the first roll made.

In use, the front portions 42, 43 of the cover 40 are unzipped as shown in FIG. 9. The folded shirt shown in FIG. 7 is then placed in the open cover 40 and the collar 26 is lightly folded over where this joins the shirt body to lie over front portion 12 so that the collar 26 lies approximately perpendicular to edge 13 of front portion 12. The collar is then inserted into the receptacle 52 so that the collar is entirely enclosed (together with a little of the shirt body) within the receptacle 52. In FIG. 10, the collar 26 is in the process of being inserted into the receptacle and is shown part away in.

Figure 12:
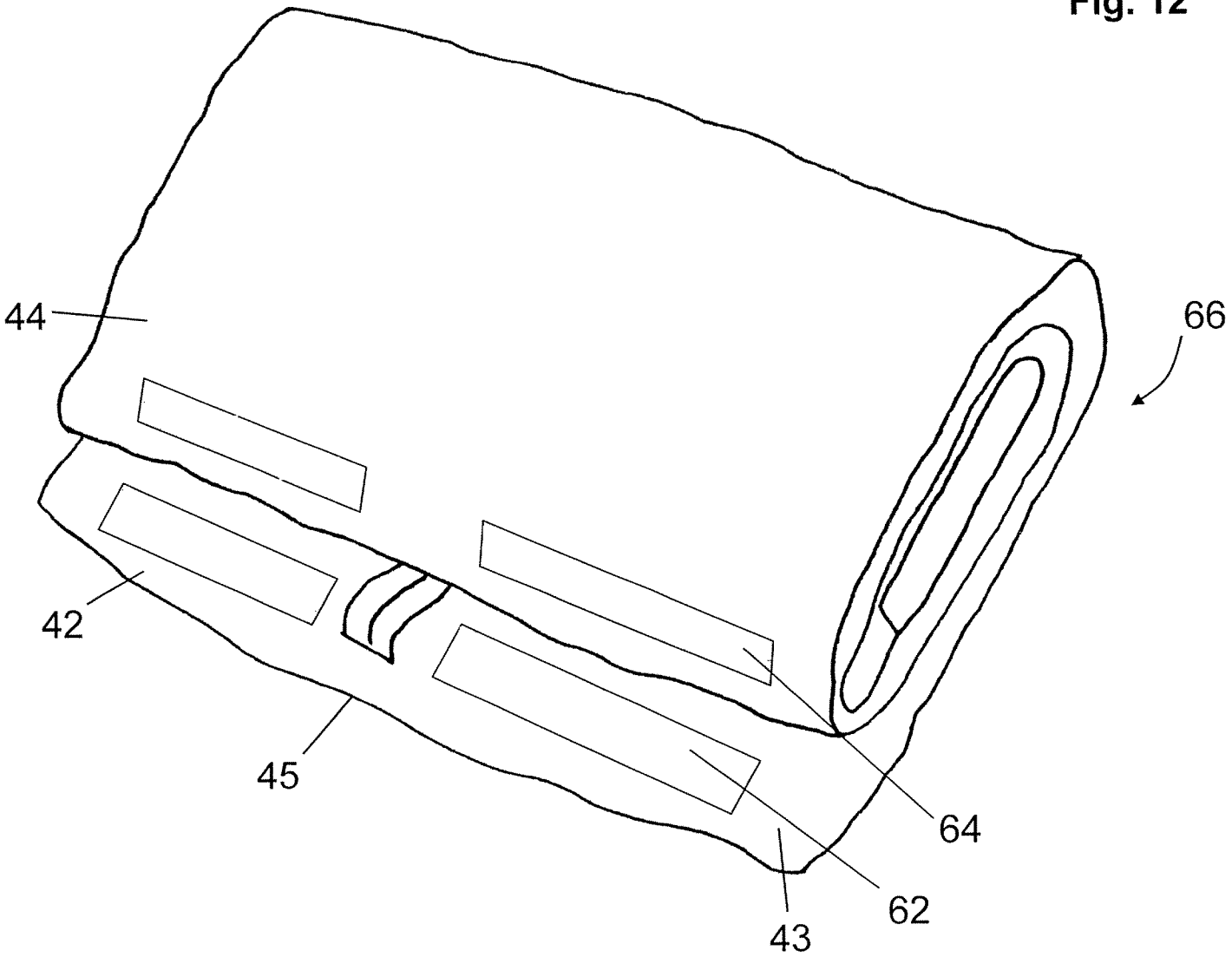
FIG. 12 shows the garment bag of FIG. 10 in a rolled-up configuration.
Figure 13:
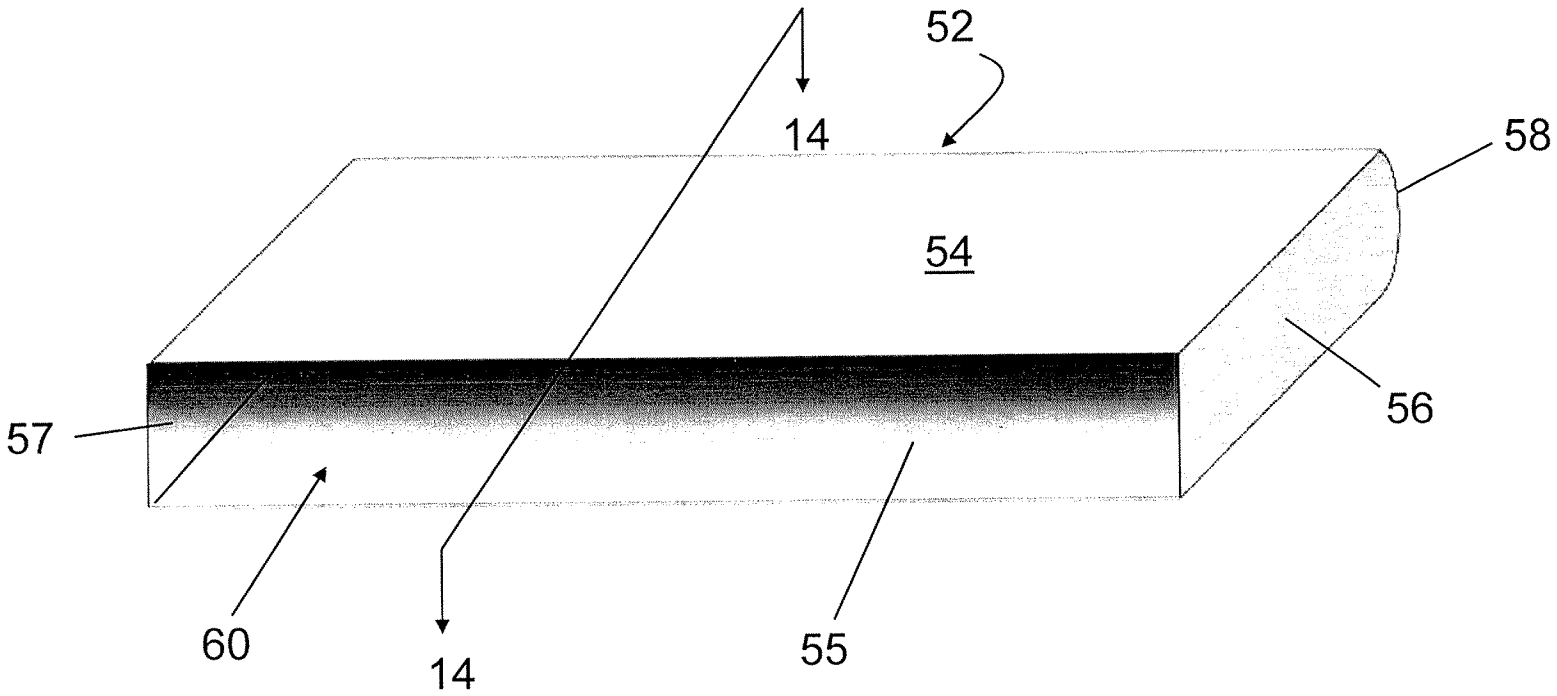
FIG. 13 is a perspective view of a receptacle being part of the garment bag of FIGS. 8 to 12.
Figure 14:
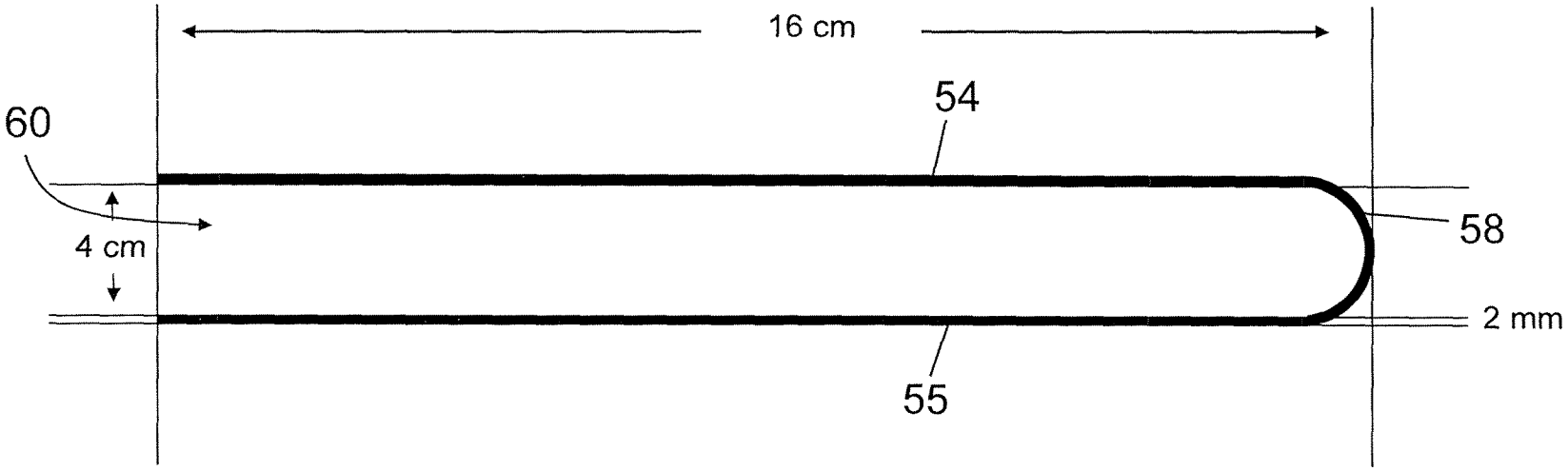
FIG. 14 is a cross-sectional view through $14^1$-$14^1$ of FIG. 13.

The front portions 42, 43 of the cover are then zipped up and the receptacle 52 is rolled over on to the front portions of the cover as shown in FIG. 11, then rolled again with the receptacle 52 providing a former for the cover. The arcuate surface 58 of the receptacle 52 provides a smoothly curved region for the cover to follow without sharp edges, to avoid creasing. This is continued until the cover is completely rolled up around the receptacle 52, as shown in FIG. 12. Velcro™ portions 62 are provided at the end 45 of the front portions 42, 43 of the cover with complementary Velcro™ portions 64 being provided at a one roll-distance on the rear portion 44 of the cover. Once the Velcro™ portions 62, 64 are attached, a "shirt-roll" package 66 is formed which can easily be transported in a suitcase or otherwise.

Since the package is rolled up rather than folded, there are no additional folds or crease points in the shirt itself and even though the package is flexible the roll also has some resistance to creasing even if squashed since the rolled layers of the shirt and cover support each other. The collar, protected by the relatively rigid receptacle 52 is in any event protected.

The embodiment described is not to be construed as limitative. For example, although the receptacle 52 has been shown and described connected to one end of the cover, the cover may, essentially, be like an ordinary garment bag, sealed along all sides and ends with the receptacle being separate. In such an arrangement, the receptacle may be slipped over the collar of a shirt folded as described and the shirt and the receptacle inserted together into the cover which is then zipped up and rolled up around the receptacle.

Furthermore, although a principal application of the embodiment of the invention is in packing of a collared shirt for travel, the folding method and garment bag may equally be used for packaging of shirts for transport and shipping to shops for subsequent display and sale. In one additional preferred feature of such a packaging technique, the garment bag used in the package would be re-usable by the purchaser, for subsequent packing of the shirt for travel. The packaging would thus have a use beyond mere transport and display.

Any other suitable materials may be used for forming the garment bag other than those described for any of the applications noted. For example, a disposable version of the container could be formed from paper or lightweight plastics sheet for the cover and cardboard for the receptacle, for example for use by laundries. The garment bag may also be made from natural materials for example the cover may be formed from woven fabric such as cotton and the receptacle may be formed from leather.

The garment bag is preferably of sufficient robustness as to be reusable, but may alternatively be formed of less robust materials, with the intention that the garment gap is disposed of after a single use.

The receptacle may also be detachably connected, by press studs for example, to the cover, to allow for the cover to be replaced and/or separately laundered depending upon the material.

The opening in the front of the cover need not be longitudinal. For example this could be omitted, with the opening 50 used to insert the shirt into the cover, or disposed at the other end 45. Furthermore, the sealing means need not be a zip, it could, for example, be formed from Velcro fasteners or a press-contact plastics seal similar to that found on freezer bags, or if the opening 50 is used to insert the shirt, omitted completely.

The invention claimed is:

1. A garment bag for a collared shirt, the bag comprising a receptacle for receiving a first portion of the shirt including the collar, and a cover in the form of a sleeve with opposed front and rear faces for receiving a remainder of the shirt, the front and rear faces being adjoined to each other at longitudinal sides, wherein, when the cover of the garment bag is in position for receiving the shirt, the front face lies flat on the rear face and is able to be opened to reveal the rear face, the front and rear faces of the cover contacting the remainder of the shirt when the garment bag is in an unrolled position with the shirt inserted therein and the cover closed, and wherein, when the cover is rolled up around the receptacle, the receptacle is disposed within the rolled up cover and the front and rear faces of the cover maintain contact with the remainder of the shirt, the receptacle being of greater rigidity than the cover to provide a crush-resistant region for protecting the collar of the shirt.

2. A garment bag as claimed in claim 1 wherein the receptacle is in the form of a pocket.

3. A garment bag as claimed in claim 1 wherein the receptacle has an arcuate surface against which the cover is rolled.

4. A garment bag as claimed in claim 1 further comprising fastenings connected to opposed faces of the cover for securing the cover rolled-up around the receptacle.

5. A garment bag as claimed in claim 1 wherein the receptacle and the cover are of substantially the same width.

6. A garment bag as claimed in claim 1 wherein the receptacle acts as a former on which the cover is rolled up.

7. A garment bag as claimed in claim 1 wherein the cover is formed from a material selected from the group consisting of: sheet material, plastics material, water resistant material and paper.

8. A garment bag as claimed in claim 1 wherein the receptacle is releasably connected to the cover.

9. A garment bag as claimed in claim 1 wherein the receptacle is separate from the cover.

10. A garment bag as claimed in claim 1 wherein the bag is intended to be disposed of after a single use.

11. In combination, a garment bag as claimed in claim 1 and a shirt contained herein.

12. A shirt packaged for merchandising in a garment bag as claimed in claim 1.

13. A shirt packaged after laundering in a garment bag as claimed in claim 1.

14. A garment bag as claimed in claim 1 wherein the cover is formed from sheet material.

15. A garment bag as claimed in claim 14 wherein the cover has a longitudinal opening formed in the sheet material.

16. A garment bag as claimed in claim 15 wherein the opening is provided with a fastener.

17. A garment bag as claimed in claim 16 wherein the fastener is a zip fastener.

18. A garment bag as claimed in claim 1, wherein the remainder of the shirt and the sides of the cover form layers which support each other when rolled up.

* * * * *